United States Patent [19]

Stetson

[11] Patent Number: 4,979,368

[45] Date of Patent: Dec. 25, 1990

[54] MINIATURE INTEGRAL STIRLING CRYOCOOLER

[75] Inventor: Norman B. Stetson, Lexington, Mass.

[73] Assignee: Inframetrics, Inc., Bedford, Mass.

[21] Appl. No.: 337,054

[22] Filed: Apr. 12, 1989

Related U.S. Application Data

[62] Division of Ser. No. 188,287, Apr. 29, 1988, Pat. No. 4,858,442.

[51] Int. Cl.[5] ..... F25B 9/00

[52] U.S. Cl. ..... 62/6; 220/288; 220/378

[58] Field of Search ..... 62/6; 220/1 C, 288, 220/378

[56] References Cited

U.S. PATENT DOCUMENTS

| | | | |
|---|---|---|---|
| 1,275,507 | 8/1913 | Vuilleumier | 62/6 |
| 2,873,878 | 2/1959 | Wolf et al. | 220/378 |
| 2,919,147 | 12/1959 | Nenzell | 220/378 |
| 3,018,127 | 1/1962 | Dobrosielski et al. | 220/378 |
| 3,144,162 | 8/1964 | Morris | 220/378 |
| 3,296,808 | 1/1967 | Malik | 62/6 |
| 3,302,664 | 2/1967 | Plamann | 220/378 |
| 3,367,121 | 2/1968 | Webb | 62/6 |
| 3,421,331 | 1/1969 | Webb | 62/6 |
| 3,877,239 | 4/1975 | Leo | 62/6 |
| 3,889,119 | 6/1975 | Whicker et al. | 250/352 |
| 3,991,586 | 11/1976 | Acord | 62/6 |
| 4,024,727 | 5/1977 | Berry et al. | 62/6 |
| 4,074,908 | 2/1978 | Spencer | 277/44 |
| 4,206,604 | 6/1980 | Reich | 60/518 |
| 4,350,012 | 9/1982 | Folsom et al. | 60/520 |
| 4,359,872 | 11/1982 | Goldowsky | 62/6 |
| 4,387,568 | 6/1983 | Dineen | 60/520 |
| 4,413,474 | 11/1983 | Moscrip | 60/517 |
| 4,418,533 | 12/1983 | Folsom | 60/520 |
| 4,429,732 | 2/1984 | Moscrip | 165/10 |
| 4,438,631 | 3/1984 | Sarcia | 62/6 |
| 4,475,346 | 10/1984 | Young et al. | 62/6 |
| 4,478,046 | 10/1984 | Saito et al. | 62/6 |
| 4,501,120 | 2/1985 | Holland | 62/6 |
| 4,514,987 | 5/1985 | Pundak et al. | 62/6 |
| 4,522,032 | 6/1985 | Nakamura | 62/6 |
| 4,522,033 | 6/1985 | Jensen | 62/6 |
| 4,537,320 | 8/1985 | Nielson | 220/288 |
| 4,539,818 | 9/1985 | Holland | 62/6 |
| 4,546,613 | 10/1985 | Eacobacci et al. | 62/55.5 |
| 4,550,571 | 11/1985 | Bertsch | 62/6 |
| 4,553,398 | 11/1985 | Young | 62/6 |
| 4,569,203 | 2/1986 | Rawlings et al. | 62/6 |
| 4,574,591 | 3/1986 | Bertsch | 62/6 |
| 4,589,564 | 5/1986 | Olster et al. | 220/378 |
| 4,597,175 | 7/1986 | Anderson et al. | 29/827 |
| 4,610,143 | 9/1986 | Stolfi et al. | 62/6 |
| 4,611,467 | 9/1986 | Peterson | 62/55.5 |
| 4,619,112 | 10/1986 | Colgate | 62/6 |
| 4,698,576 | 10/1987 | Maresca | 318/687 |
| 4,707,998 | 11/1987 | Linner et al. | 62/349 |
| 4,711,650 | 12/1987 | Faria et al. | 62/6 |
| 4,722,188 | 2/1988 | Otters | 60/517 |

*Primary Examiner*—Ronald C. Capossela

*Attorney, Agent, or Firm*—Nutter, McClennen & Fish

[57] ABSTRACT

An integral cryogenic refrigerator, or cryocooler, for cooling an electronic device to cryogenic temperature. The cryocooler has a minimum number of moving parts. A lightweight flexure links a compressor piston to a coupler which is also connected to a regenerator via a lightweight vane. An electric motor with an offset shaft drives the coupler via a bearing through a circular path to impart properly timed motion to the compressor piston and regenerator. This arrangement minimizes the weight and number of moving parts, resulting in maximum efficiency and operating life. Vibration transmission is minimized by mounting the device to be cooled on an end cap having a raised castlated rim. A reusable access port allows the cryocooler to be readily recharged.

6 Claims, 5 Drawing Sheets

MINIATURE INTEGRAL STIRLING CRYOCOOLER

CROSS-REFERENCE TO RELATED APPLICATION

This application is a division of Ser. No. 188,287, filed Apr. 29, 1988, now U.S. Pat. No. 4,858,422.

FIELD OF THE INVENTION

This invention relates generally to the field of cryogenics, and particularly to a highly efficient, miniature integral Stirling cryocooler.

BACKGROUND OF THE INVENTION

The need for cooling electronic devices such as infrared detectors to cryogenic temperatures is often met by miniature refrigerators operating on the Stirling cycle principle. As is well known, these cryogenic refrigerators, or cryocoolers, use a motor driven compressor to impart a cyclical volume variation in a working volume filled with pressurized refrigeration gas. The pressurized refrigeration gas is fed from the working volume to one end of a sealed cylinder called a cold well. A piston-shaped heat exchanger or regenerator is positioned inside the cold well. The regenerator has openings in either end to allow the refrigeration gas to enter and exit.

The regenerator thus reciprocates in response to the volume variations in the working volume, and the refrigeration gas is forced to flow throw it in alternating directions. As the regenerator reciprocates, the end of the cold well which directly receives the refrigeration gas becomes much warmer then the ambient. In the other end of the cold well, called the expansion space or cold end, the gas becomes much colder than ambient. The electronic device to be cooled is thus mounted adjacent the expansion space, on the cold end of the cold well.

Because the cold well is sealed, the volume of the expansion space also varies as the regenerator reciprocates. It is known that the efficiency of the Stirling cryocooler is optimized by properly timing the movement of the regenerator. In particular, its movement should be such that the variations in the volume of the expansion space lead the variations in the volume of the compression space by approximately 90°. This insures that the working volume pressure and thus temperature are at a peak before the refrigeration gas enters the regenerator from the working volume.

The two most common configurations of Stirling cryocoolers are referred to as "split" and "integral". The split Stirling type has a compressor which is mechanically isolated from the regenerator. Cyclically varying pressurized gas is fed between the compressor and regenerator through a gas transfer line. In most split Stirling cryocoolers proper timing of regenerator movement is achieved by using precision friction seals.

In an integral Stirling cryocooler, the compressor, regenerator and cold well are assembled in a common housing. The typical arrangement uses an electric motor to drive the moving parts. A crankshaft, disposed in a crankcase, uses multiple cams to properly time compressor and regenerator movement, much as an internal combustion engine uses a crankshaft and cams to provide proper timing of the movement of its parts. As such, the typical integral cryocooler requires several bearings to support the cams and crankshafts. If connecting rods are used to couple the compressor and regenerator to the cams, additional bearings are required. One problem with this arrangement is that these bearings require a lubricant. Unfortunately, even the best of lubricants contain some minute amount of abrasives, and the moving parts eventually wear. Because efficient cryocooler operation requires maintaining extremely small, critical dimensional tolerances, even the minute contaminations carried in the lubricant cause unacceptable wear of the moving parts, which in turn severely shortens operating life.

One way to minimize this problem is to lower the pressure inside the crankcase. While this allows the bearings to be made smaller, thus decreasing the requirement for lubrication as well as the input power required to drive the moving parts, the lower pressure actually results in lower cooling efficiency. Thus, this is not a practical solution where it is also important to minimize power consumption.

Minimizing the size and weight of the bearings is also important where the entire cryocooler must be made as small and light weight as possible.

Another difficulty occurs with the crankcase. The normal arrangement is to pre-pressurize the crankcase through an access port. A lead or indium plug is then deformed into and around the port opening by a threaded set screw. The problem with this arrangement is that in order to obtain access to the crankcase at a later time, such as to repressurize, the plug must be cleaned out or scraped away to obtain access to the port.

Certain applications have traditionally dictated the use of split cryocoolers. For example, split cryocoolers are generally preferred in such applications as gimbal mounted infrared detectors, since only the regenerator and cold well need to be mounted on the gimbal, and the compressor can be remotely mounted. This reduces the weight of parts which must be mounted on the gimbal. Additionally, an integral cooler necessarily has a greater number of moving parts. Because moving parts transmit vibration to their environment, the need to mitigate vibration also sometimes dictates the use of split cryocoolers. However, spilt cryocoolers are normally expected to have a shorter operating life because their friction seals wear out more quickly.

In order to achieve maximum cooling efficiency, the device to be cooled must be mounted as close as possible to the expansion space. However, certain devices, such as mercury cadmium telluride detectors, are very sensitive to stress and strain. Thus, the minute vibrations caused at the regenerator cold end in response to the cyclical pressure variation have been found to adversely affect the operation of such detectors. The only solution to this problem previously has been to mount the detector farther away from the regenerator. However, this isolation between detector and regenerator adversely affects cooling efficiency.

SUMMARY OF THE INVENTION

It is thus an object of this invention to provide a highly efficient integral Stirling cryocooler.

In brief summary, an integral cryocooler constructed in accordance with this invention includes a motor having an offset shaft which drives a coupling through a circular path. The compressor and regenerator are connected to the coupling at right angles to impart the required timing for compressor and regenerator movement. Only a single bearing is used to mate the coupling with the end of the offset shaft. With this arrangement a simple flexure or vane can be used to connect the compressor and regenerator to the coupling.

Several advantages over prior cryocoolers result from this novel arrangement. The offset shaft and coupling eliminate the need for a crankshaft, multiple cams and the associated multiple bearings. Simple flexures and vanes replace connecting rods and bearings. Thus only a single bearing requiring lubrication is needed. Higher efficiency results since less energy is lost in bearing movement, and more energy can be used for the desired purpose of moving the compressor and regenerator. Longer operating life is also experienced because fewer lubricated parts mean less lubricant is required, and hence a longer time elapses before contaminants cause excessive wear. Fewer moving parts means that the cryocooler is lighter, and that the amount of vibration transmitted to the environment is also reduced. Thus, an integral cryocooler can be used where light weight or portability is important, which until now has been impractical.

A cryocooler in accordance with the invention may also have a rim formed along the outer diameter of the end of the cold well. The cooled device is mounted on this rim, directly to the cold well. However, the only mechanical communication between the detector and the regenerator is along this outer diameter, and not with their center portions. The rim is preferably castlated.

This arrangement maximizes cooling efficiency, because the cooled device is directly mounted to the cold well. It also transmits a minimum amount of vibration to the cooled device, because the gap formed between the device and cold well rim allows the cold well end to flex in response to vibrations caused as the regenerator reciprocates. A castlated rim can be used to further reduce transmission of vibration to the device.

Another feature of this invention is a pressurization port which accommodates a set screw and a deformable seal such as an anodized copper washer. The bottom of the set screw has an annulus with an inner diameter greater than the inner diameter of the washer. Upon tightening the set screw against the washer, sufficient force is supplied to cause the washer to deform and thus adequately seal the port.

The advantage of this arrangement is that the port can be readily opened and closed without the need to clean out plug material, thus enabling expedited recharging of the pressurized crankcase.

BRIEF DESCRIPTION OF THE DRAWINGS

This invention is pointed out with particularity in the appended claims. The above and further advantages of the invention may be better understood by referring to the following description in conjunction with the accompanying drawings, in which:

DETAILED DESCRIPTION OF ILLUSTRATIVE EMBODIMENTS

Figure 1:
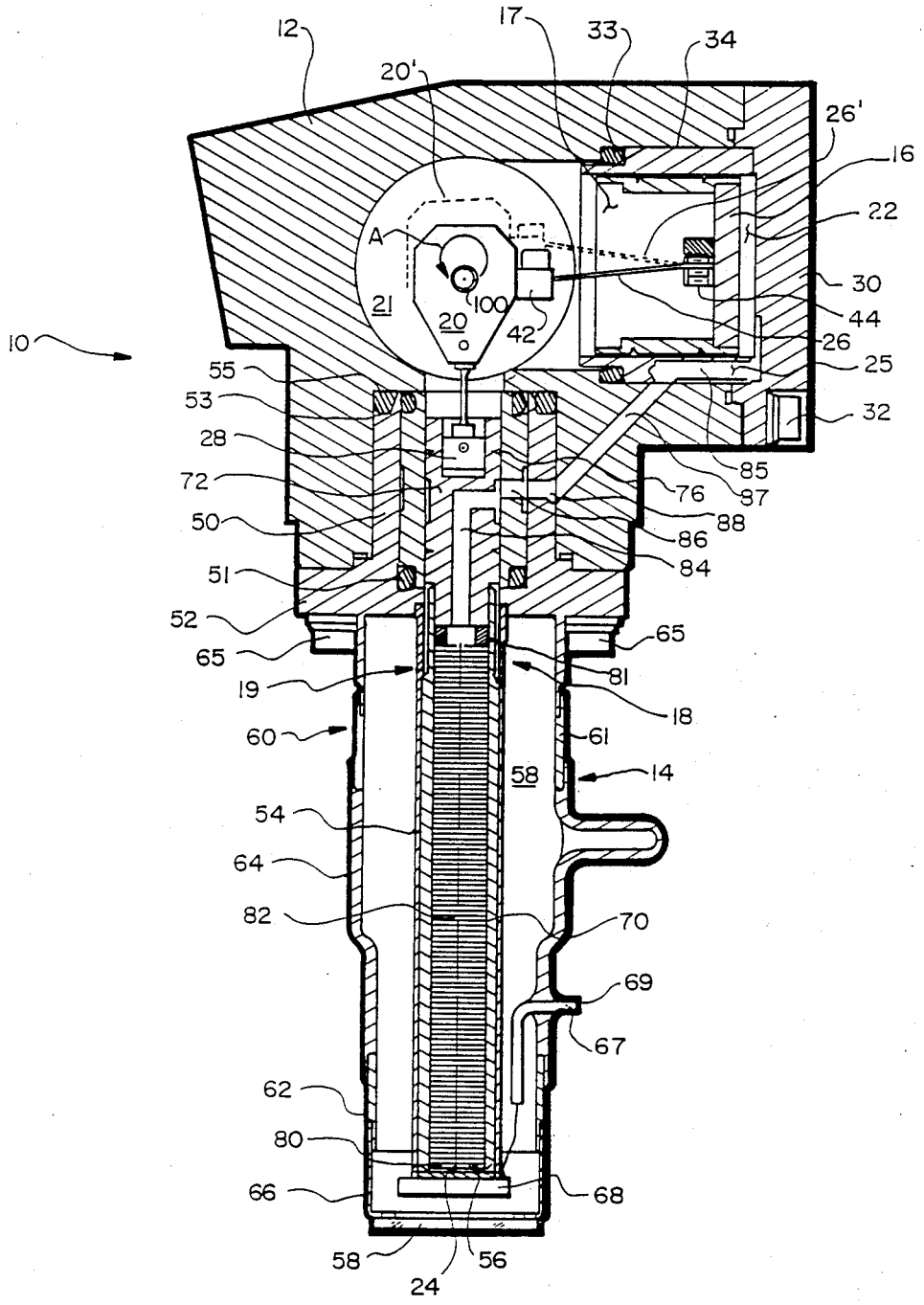
FIG. 1 depicts a sectional view of an integral cryocooler according to the invention.

Referring now in particular to the drawings, there is shown in FIG. 1 a sectional view of an integral cryocooler 10 in accordance with the invention. The cryocooler 10 includes a crankcase 12, a dewar assembly 14, a hollow compression piston assembly 16, a regenerator assembly 18, and a drive coupler 20.

Cryocooler 10 is of a type referred to as a two piston V-form integral Stirling cryocooler. Formed in the crankcase 12 are a compression cylinder 17, a cold well or expansion cylinder 19, and a chamber 21. The compression cylinder 17 and expansion cylinder 19 are formed at right angles to one another, and also at right angles to the chamber 21. The chamber 21 opens into both the compression cylinder 17 and the expansion cylinder 19. The compression cylinder 17 and expansion cylinder 19 are filled with a refrigeration gas, such as helium. As is conventional, the compression piston 16 reciprocates inside the compression cylinder 17, and the regenerator 18 reciprocates inside the expansion cylinder 19. These are formed from suitable materials such as steel such as for the cylinders 17 and 19, which must resist wear, and aluminum for the reciprocating components 16 and 18, which should be lightweight. The steel and aluminum must have similar thermal expansion properties to maintain the close tolerances necessary. In particular, the outer diameter of compression piston 16 and inner diameter of compression cylinder 17 must be precisely machined to a close fit, so that a clearance seal is formed between them. This is also true of the outer diameter of the regenerator 18 and the expansion cylinder 19.

A sinusoidal pressure and volume variation is thus imparted to the pressurized gas by the reciprocation of compression piston 16. This sinusoidal variation occurs in a compression space 22 portion of the compression cylinder 17 formed above the head of the compression piston 16 (which is to the right of compression piston 16 in the orientation shown in FIG. 1). A passage 25 allows the volume and pressure variation to be communicated to the regenerator 18.

More particularly now, the compression piston 16 is connected to the coupling 20 by way of a flexure 26. Flexure 26 is a solid piece of flexible, lightweight, and preferably metallic material. Flexure 26 is sufficiently flexible to allow it to be positioned alternately between the position 26 shown with solid lines and the position 26' shown with dashed lines.

The regenerator 18 is connected to the coupling 20 by means of a regenerator vane 28. A flexure similar to flexure 26 may be used in the place of vane 28. The proper phasing between movement of the compression piston 16 and regenerator 18 is thus achieved by mounting the flexure 26 and regenerator vane 28 at right angles to one another on the coupling 20.

In operation, the drive coupler 20 is moved by an electric motor (not shown in FIG. 1) connected to a bearing 100 mounted in the coupling 20. The motor causes the drive coupler 20 to traverse a circular path as indicated by the letter A. The position of drive coupler 20 shown by the solid lines is its position when the regenerator 18 is at bottom dead center, which corresponds to the position of smallest expansion space 24 volume. The position shown by dashed line 20' for drive coupler 20 is top dead center for regenerator 18, or that of maximum expansion space 24 volume. The drive coupler 20 also passes through positions not shown in FIG. 1 which occur as the circular path A is traversed. Thus, positions to the left and right of the positions shown are passed through, which represent the positions of bottom dead center and top dead center, respectively, of compression piston 16.

The movement of regenerator 18 is thus properly phased with the movement of compressor piston 16, so that the pressure in compression space 22 is at a maximum before the regenerator 18 begins its descent in expansion cylinder 19. This in turn allows the gas in the expansion space 24 at the bottom end of the expansion cylinder 19 to become as cold as possible. A large temperature gradient is thereby formed between the top of regenerator 18, nearest the passage 25, and the bottom of regenerator 18, nearest the expansion space 24.

Because the compression cylinder 17, expansion cylinder 19, and chamber 21 are pre-pressurized to the minimum cyclic pressure experienced in the compression cylinder 17, the mechanical load on the flexure 26 and vane 28 is greatly reduced. This means that the flexure 26 and vane 28 can be made of lightweight materials. Pre-pressurization also allows the stroke of compression piston 16 to be smaller. A smaller angle of obliquity results from using a shorter piston stroke, which also assists in allowing the flexure 26 to be used instead of a heavier connecting rod and bearings. Lightweight components require less lubrication, which means the chance of lubricant contamination and premature wear of the components of cryocooler 10 is reduced.

A coupling 20 having a single bearing 100, a flexure 26, and a vane 28 formed of lightweight materials thus eliminates the need for multiple, heavier bearings for supporting a crankshaft and multiple cams. The amount of lubricant required is correspondingly reduced. This results in longer operating life since there is less lubricant to contaminate. The lighter net weight allows the use of an integral cryocooler 10 in applications where previously only split cryocoolers could be used.

Any given shaft and bearing interface is not a perfect mechanism, since the shaft outer diameter must be somewhat smaller than the bearing inner diameter. Thus, in addition to the desired rotary movement between the bearing and the shaft, undesired movement along the central axis of the shaft will occur. This undesired movement is a source of vibration and even audible noise. Typical prior integral Stirling cryocoolers required five or even more bearings, which of course generated more vibration that the single bearing used in the illustrated embodiment.

Additional advantages are afforded by this arrangement. As the compression piston 16 reciprocates, a side force is created by the angle of obliquity of the flexure 26, causing one side of the piston 16 to bear more heavily on the cylinder 17 than the other. The resulting uneven wear deteriorates the clearance seal formed between the compression piston 16 and cylinder 17, shortening the operating life of the cryocooler 10. The use of a lightweight flexure 26 minimizes this problem, since a conventional connecting rod arrangement is heavier and has a greater angle of obliquity.

Figure 2:
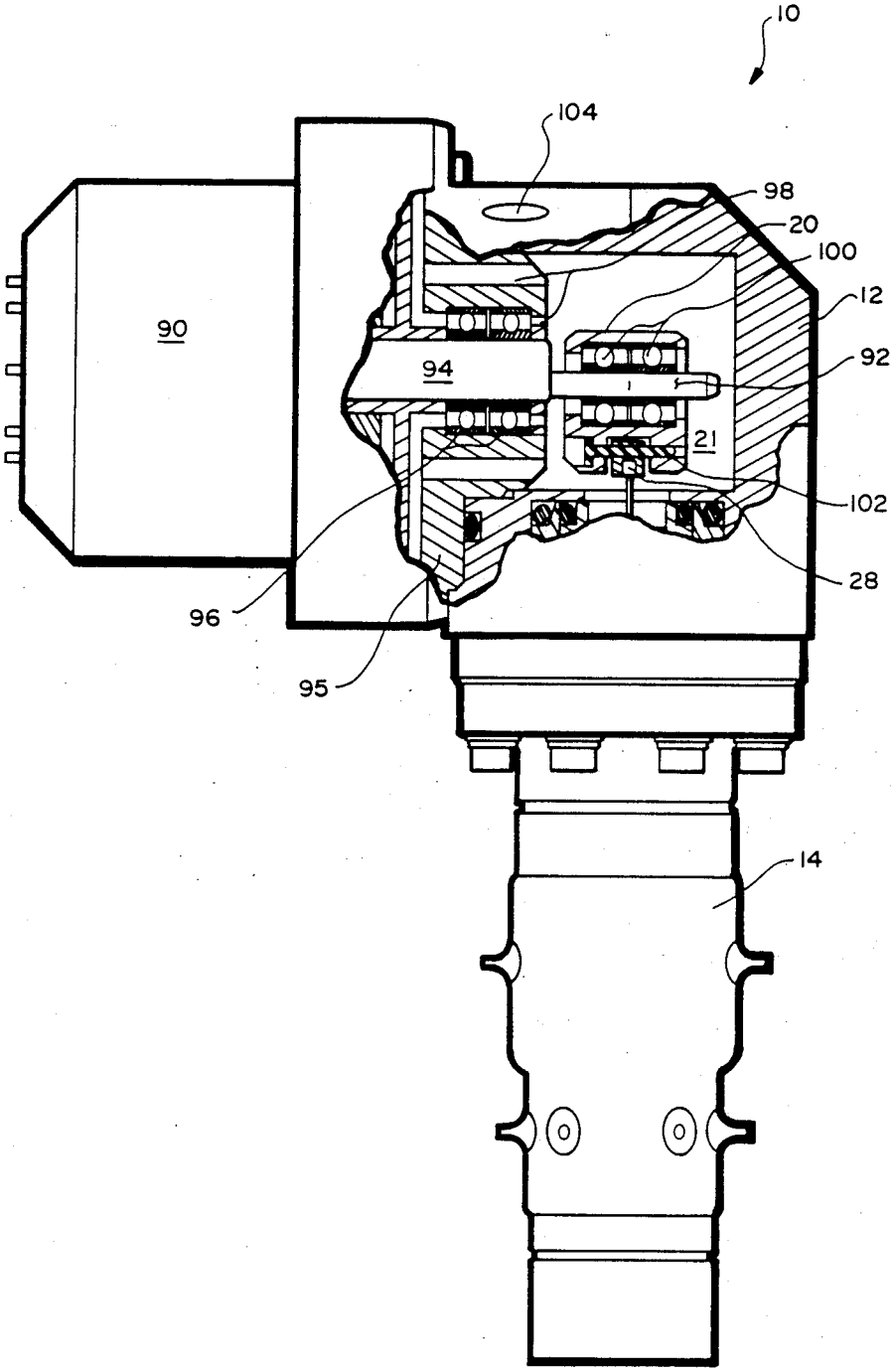
FIG. 2 is a cut away view of the cryocooler, taken perpendicular to the view of FIG. 1, and shows the connection between a drive motor, compression piston, and regenerator.

Turning attention now to FIG. 2, the configuration of cryocooler 10, and in particular the drive coupler 20 can be further understood. This is a partial sectional view taken perpendicular to the view of FIG. 1. It shows the electric motor 90 having a motor shaft 94 and coupling dowel 92. Coupling dowel 92 is of a smaller diameter than motor shaft 94 and is mounted or formed off center. Coupling dowel 92 thus serves as an offset shaft providing the desired force necessary to move drive coupler 20 in the required path. The motor shaft 94 is supported in the motor housing 95 by shaft bearing 96, as is conventional for most motors. Passages 98 formed in motor housing 95 allow the pressurized gas in chamber 21 to communicate with the motor 90. This enables motor 90 to operate at the elevated pressure of chamber 21, and not the ambient, so that it need only work hard enough to overcome the cyclic pressure differential experienced in the working space 24, and not the much larger pressure difference between the ambient and working space 24.

A bearing 100 is mounted where drive coupler 20 engages the coupling dowel 92. The bearing 100 is preferably embodied as an instrument grade duplex bearing pair and spacer, since that configuration reduces variation in angular contact between the drive coupler 20 and coupling dowel 92 due to dimensional tolerances. Bearing 100 is the only bearing required to impart the desired motion to the compressor piston 16 and regenerator 18, while retaining the aforementioned advantages.

Also shown in FIG. 2 is a pivot pin 102, which is used to connect the regenerator vane 28 to drive coupler 20. The pivot pin 102 may be secured to the drive coupler 20 by an appropriate adhesive, such as Loctite. Loctite is a trademark of the Loctite Corporation, Newington, Conn., for its settable resinous adhesive products.

A port 104 in housing 12 allows access to chamber 21 so that it may be pre-pressurized. Port 104 and its seal are discussed in greater detail in connection with FIG. 7.

Returning attention now to FIG. 1, it is seen that the compression space 22 and a portion of passage 25 are defined by a compression cylinder head 30 mounted to crank case 12 at the top of the compression cylinder 17. The cylinder head 30 is attached to crankcase 12 by suitable fasteners 32.

A compression sleeve 34, formed of a hardened material such as stainless steel, defines the compression cylinder 17. Compression sleeve 34 is machined to a close tolerance with the outer walls of compression piston 16. This close tolerance forms a clearance seal which prevents leakage of refrigeration gas between compression space 22 and chamber 21. In this manner, most of the sinusoidal pressure variation is imparted to the refrigeration gas in compression space 22, and pressure in the chamber 21 remains nearly constant. The compression sleeve 34 has an axial bore 85 which forms part of the passage 25. An O-ring seal 33 can be placed at the interface between crankcase 12 and a compression sleeve 34, or these components can be integrally formed. Separate fabrication of the crankcase 12 and compression sleeve 34 may facilitate precision machining of compression sleeve 34 to match the outer walls of compression piston 16, although O-ring seals are more prone to leakage.

A machine screw or other fastener 44 is used to attach the flexure 26 to compression piston 16. A similar fastener 42 is used to attach the other end of the flexure 26 to the drive coupler 20.

The expansion cylinder 19 is defined by a regenerator sleeve 50, cold well base 52, and cold well tube 54. The regenerator sleeve 50, formed of a hardened material such as stainless steel, has an inner diameter machined to a close fit to the outer diameter of the upper end of cold well base 52. Appropriate O-ring seals 51 and 53 are preferable disposed at the interface of regenerator sleeve 50 and the cold well base 52. Another O-ring seal 55 may be placed at the interface between cold well base 52 and crankcase 12. The outer diameter of cold well base 52 matches the inner diameter of a cylindrical opening formed in the bottom of crankcase 12. Additional holes 86 and 88 may also be formed in the regenerator sleeve 50 and cold well base 52, respectively, to form the passage 25 which allows communication of the pressurized gas to the expansion cylinder 19.

Convection heat transfer is minimized by enclosing the expansion cylinder 19 in a vacuum insulated dewar 60. An insulating space 58, formed about the outside of expansion cylinder 19 by the dewar 60, is evacuated during construction of the cryocooler 10. Dewar 60 includes the lower portions of cold well base 52, and upper sleeve 61, a dewar body 64, a lower sleeve 62, and a dewar end cap 66. Expansion cylinder 19 must also be sufficiently sealed to prevent refrigeration gas from escaping passage 25 or expansion space 24 into insulating space 58. Dewar body 64 may be formed of glass, metal or combination thereof. If the dewar body 64 is indeed formed of glass, it is preferable that upper sleeve 61 and lower sleeve 62 be formed of Kovar. Kovar is a trademark of the Carpenter Technology Corporation, Reading, Pa., for its alloyed metal casting products. This allows the glass dewar body 64 to expand and contract at rates different from the cold well base 52 and end cap 56 without losing the vacuum in insulating space 58. A tube 67 mounted in the dewar body 64 allows a detector lead 69 to be fed from a device to be cooled such as a detector 68 mounted at the bottom of expansion cylinder 19 to electronic equipment, which not shown in FIG. 1.

The regenerator 18 includes a regenerator tube 70 formed of epoxy fiberglass, a regenerator piston 72 arranged to engage the upper end of regenerator tube 70, and a regenerator sleeve 50. The outer diameter of regenerator piston 72 is precisely machined to match the inner diameter of regenerator sleeve 50, so that a precision clearance seal is formed between the pressurized gas in expansion cylinder 19 and the chamber 21. A labyrinth seal 76 in the form of annular grooves may also be formed on the outer diameter of the regenerator piston 72. This further increases the sealing action between the regenerator sleeve 50 and regenerator piston 72. In the upper end of the regenerator tube 70 is a upper regenerator retainer 80 and in its lower end a lower regenerator retainer 81. Retainers 80 and 81 keep metallic heat exchanging regenerator discs 82 from escaping the regenerator 18 while allowing refrigeration gas to enter and exit the regenerator 18. It is the alternate cooling and heating of these discs 82 which allow the expansion space 24 to become extremely cold. An appropriate opening 84 is formed in the regenerator piston 72 to allow pressurized gas from compression space 22 to communicate with the regenerator discs 82 inside of the regenerator tube 70.

Figure 3A:
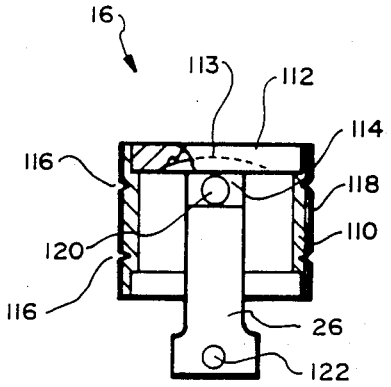
FIGS. 3A and 3B are detailed cross sectional view of one embodiment of the compressor piston and an associated flexure.
Figure 3B:
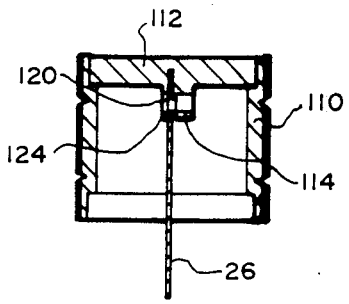

FIGS. 3A and 3B are more detailed front and side views, respectively, of compressor piston 16. Compression piston 16 is of the hollow type, including a hollow piston wall cylinder 110, and compression piston head 112. A labyrinth seal 116 is formed by cutting appropriately shaped grooves in the outer diameter of piston wall 110. The outer diameter of piston wall 110 is covered with a lubricant such as Rulon 118, which may be sprayed in liquid form or attached in solid form. Rulon is a trademark of Dixon Industries Corporation, Bristol, R.I., for its tetrafluroethylene polyimide lubricants. A split clamp 114, appropriately sized to accommodate flexure 26, is either integrally formed with or mounted to the compression piston head 112. A upper hole 120 formed in flexure 26 allows it to be secured to clamp 114. A lower hole 122 formed in the flexure 26 allows it to be connected to drive coupler 20 with an appropriate fastener.

Figure 4A:
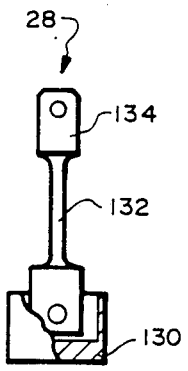
FIGS. 4A and 4B are detailed cross sectional views of a regenerator vane.
Figure 4B:
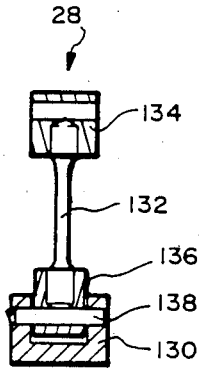

FIGS. 4A and 4B are front and side views, respectively, of vane 28. Vane 28 includes a vane plug 130 shaped to engage a cylindrical depression formed in the upper end of the regenerator piston 72. A vane shaft 132 is coupled to plug 130 via a pivoting link 136 and vane pin 138. A pivot 134 is used to secure vane 28 to the drive coupler 20, as was shown in FIG. 2. This arrangement has been found to provide an adequate connection between regenerator 18 and drive coupler 20 without the use of bearings. It needs no lubrication. Loctite adhesive is applied to the outer surfaces of plug 130, regenerator piston 72 to insure solid contact.

Figure 5:
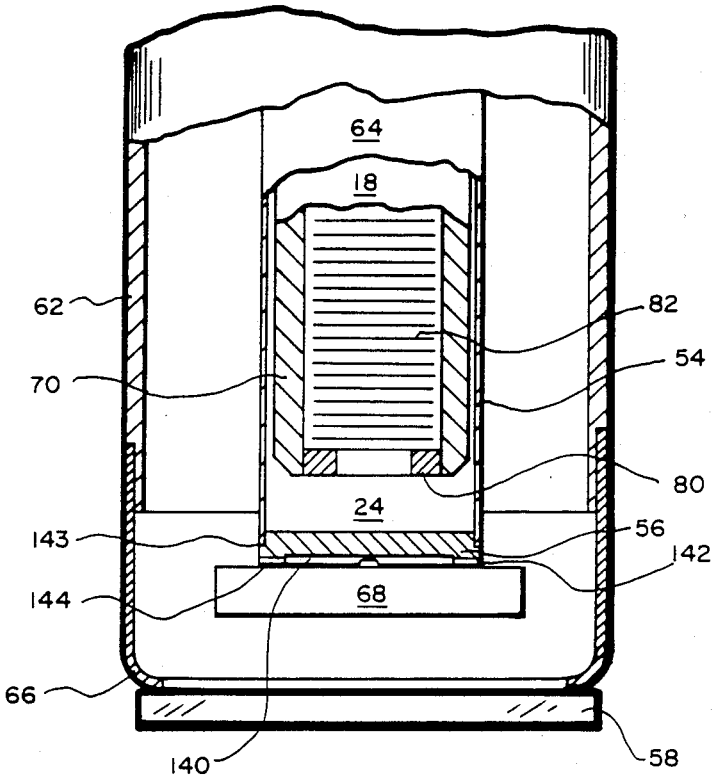
FIG. 5 is a detailed cut away view of the cold end of the cryocooler.

FIG. 5 shows the cold end of the cryocooler 10, where the arrangement of the detector or other device to be cooled 68 and regenerator 18 may be more clearly seen. A cold well end cap 56 is braised onto the end of the cold well tube 54. End cap 56 includes a rim 142 forming an annulus around its lower outer diameter. This rim 142 serves to insure the end cap 56 engages only the outer periphery of the device 68. A notch 143 formed around the upper outer diameter of end cap 56 assists in more firmly seating end cap 56 to the end of the cold well tube 54.

Figure 6:
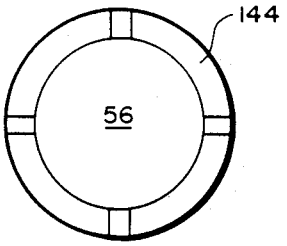
FIG. 6 is a plan view of a castlated cold well cap used with the regenerator.

Furthermore, the end cap 56 may be castlated, so that the rim 142 is created by multiple foot portions 144 spaced along the outer diameter of end cap 56. FIG. 6 is a bottom view of the cold well end cap 56, showing the foot portions 144 more clearly.

By mounting the device 68 so that it contacts the end cap 56 only where the end cap 56 is also supported by the end of cold well tube 56, minimum vibration is transferred to the detector 68. More particularly, as the pressure variation in the expansion space 24 occurs due to reciprocation of the regenerator 18, the central portion of end cap 56 is also caused to bulge inwardly and outwardly, or "oil can". The space 140 created by the rim 142 between the device 68 and the end cap 56 allows the central portion of the end cap 56 to flex up and down without contacting the device 68. Minimizing vibration transmission to the device 68 is especially critical when the device 68 is an infrared detector formed of mercury cadmium telluride. Such a detector actually acts as a strain gauge, so that even minimal vibrations distort the electrical output signal voltage, which is ideally dependent upon only the amount of detected infrared light.

Figure 7:
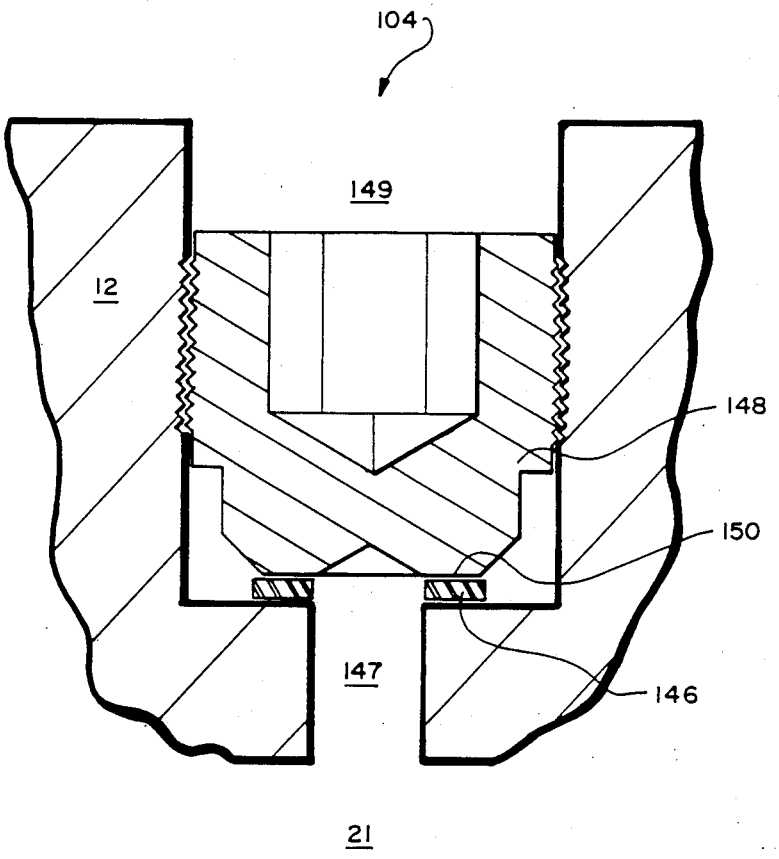
FIG. 7 is a sectional view of a fill port used with the cryocooler.

FIG. 7 shows the pressure port 104 in greater detail. It includes an inner opening 147 formed in the crankcase 12 to allow access to the chamber 21. An threaded upper opening 149 having an inner diameter greater than that of opening 147 is formed outboard of the inner opening 147. An annealed copper washer 146 is placed in the port 104. Washer 146 has an inner diameter greater than or equal to the diameter of the inner opening 147. Its outer diameter is somewhat less than that of the upper opening 149 of port 104. A fastener 148, such as a cut point set screw, is fit to the threaded opening 149. Cut point set screws are commonly available with cone-shaped ends. By lapping the cone-shaped end, an annulus 150 is formed thereon. The annulus 150 is sized to the same approximate cross sectional area as the surface area of the washer 146. This arrangement has been found in practice to provide sufficient sealing of chamber 21, while allowing access to recharge cryocooler 10 by merely unscrewing the fastener 148. The time required to recharge cryocooler 10 is thus greatly reduced.

Several advantages thus result from the structures disclosed in this specification. The offset shaft 92 and coupling 20 eliminate the need for a crankshaft, multiple cams and associated multiple bearings to support the crankshaft. Simple, lightweight flexures and vanes replace heavier connecting rods and bearings. Because only a single lubricated bearing is needed, the resulting cryocooler 10 has several advantages over prior configurations. Less energy is lost in bearing movement, and more energy can be used for the desired purpose of moving the compressor and regenerator. The cryocooler is thus more efficient, as it requires less energy to provide a given amount of cooling power. Longer operating life is also experienced, because fewer lubricated parts mean less lubricant is required, and hence a longer time elapses before contaminants in the lubricant cause excessive wear. Fewer moving parts also means that the cryocooler 10 is lighter. Because mating components with undesired play have been eliminated, the amount of vibration transmitted to the environment is reduced. This enables using an integral cryocooler where light weight or portability is important, which until now has been impractical.

The gap 140 formed between the device 68 and cold well end cap 56 allows the central portion of the end cap 56 to flex in response to forces caused as regenerator 18 reciprocates. Thus, only the minimal vibration caused along the outer periphery of the end cap 56 is transmitted to the device 68. The castlation provided by foot portions 144 in the end cap 56 further reduces the effects of vibration.

The access port 104 can be readily opened and closed without the need to clean out plug material, thus enabling expedited recharging of the pressurized crankcase 12.

The foregoing description has been limited to specific embodiments of this invention. It will be apparent, however, that variations and modifications may be made to the invention, with the attainment of some or all of its advantages. Therefore, it is the intent of the appended claims to cover the variations and modifications which come within the true spirit and scope of the invention.

What is claimed as new and desired to be secured by Letters Patent of the United States is:

1. In a cryocooler, a pressurization port allowing access to a crankcase chamber which opens into a compression cylinder and an expansion cylinder and comprising:

an upper threaded opening;

a lower opening, coaxially positioned beneath the upper opening and having a smaller diameter than the upper opening; and a ridge thus formed at the juncture of the upper and lower openings.

2. A cryocooler as in claim 1 additionally comprising:

a set screw having the same thread diameter as the upper threaded opening and an annulus on its lower end, the annulus having an inner diameter greater than the diameter of the lower opening.

3. A cryocooler as in claim 2 additionally comprising a deformable washer positioned on the ridge at the juncture.

4. A cryocooler as in claim 3 wherein the deformable washer is formed of annealed copper.

5. A cryocooler as in claim 1 additionally comprising a deformable washer positioned on the ridge at the juncture.

6. An apparatus as in claim 5 wherein the deformable washer is formed of annealed copper.

* * * * *